US008562033B2

(12) United States Patent
Tomaszewski et al.

(10) Patent No.: US 8,562,033 B2
(45) Date of Patent: Oct. 22, 2013

(54) DOUBLE LOCK OVERRIDE MECHANISM FOR VEHICULAR PASSIVE ENTRY DOOR LATCH

(75) Inventors: Kris Tomaszewski, Newmarket (CA); Alex Kaczmarczyk, Aurora (CA)

(73) Assignee: Magna Closures Inc., Newmarket (CA)

( * ) Notice: Subject to any disclaimer, the term of this patent is extended or adjusted under 35 U.S.C. 154(b) by 957 days.

(21) Appl. No.: 12/529,226

(22) PCT Filed: Mar. 3, 2008

(86) PCT No.: PCT/CA2008/000469

§ 371 (c)(1),
(2), (4) Date: Aug. 31, 2009

(87) PCT Pub. No.: WO2008/104089

PCT Pub. Date: Sep. 4, 2008

(65) Prior Publication Data

US 2010/0013246 A1 Jan. 21, 2010

Related U.S. Application Data

(60) Provisional application No. 60/892,289, filed on Mar. 1, 2007.

(51) Int. Cl.
*E05C 3/06* (2006.01)

(52) U.S. Cl.
USPC ..... 292/201; 292/216; 292/DIG. 23

(58) Field of Classification Search
USPC ..... 292/201, 216, DIG. 23
See application file for complete search history.

(56) References Cited

U.S. PATENT DOCUMENTS

| | | | | |
|---|---|---|---|---|
| 5,277,461 | A | 1/1994 | Dzurko et al. | |
| 5,584,515 | A * | 12/1996 | Silye | 292/201 |
| 6,045,168 | A | 4/2000 | Johnson et al. | |
| 6,067,826 | A | 5/2000 | Holloway et al. | |
| 6,079,757 | A | 6/2000 | Aubrey | |
| 6,511,106 | B2 * | 1/2003 | Perkins et al. | 292/216 |
| 6,517,128 | B2 | 2/2003 | Perkins et al. | |
| 6,764,113 | B1 * | 7/2004 | Cetnar | 292/201 |
| 6,848,727 | B1 | 2/2005 | Cetnar et al. | |
| 2002/0158475 | A1 | 10/2002 | Rice et al. | |
| 2002/0195878 | A1 | 12/2002 | Willats et al. | |
| 2005/0218661 | A1 | 10/2005 | Brose et al. | |
| 2007/0029815 | A1 | 2/2007 | Coleman et al. | |
| 2007/0205612 | A1 | 9/2007 | Graute | |

* cited by examiner

*Primary Examiner* — Kristina Fulton
(74) *Attorney, Agent, or Firm* — Millman IP Inc.

(57) ABSTRACT

In an embodiment, the door latch system is provided. A ratchet is movable between closed and open positions. A pawl is movable between ratchet locking and ratchet release positions. A release lever is movable between rest and pawl release positions. A lock link is movable between engagement and disengagement positions to transfer of not transfer movement of the release lever to the pawl release position into movement of the pawl to the ratchet release position. A double lock lever is movable between two positions to permit or prevent disengagement of the lock link. A double lock override lever is movable between two positions to permit or prevent the double lock lever from being in the double locking position. The ratchet can move the double lock override lever to the first position upon opening.

6 Claims, 6 Drawing Sheets

DOUBLE LOCK OVERRIDE MECHANISM FOR VEHICULAR PASSIVE ENTRY DOOR LATCH

CROSS-REFERENCE TO RELATED APPLICATIONS

This application is a national phase entry filed under 35 U.S.C. section 371, of PCT application no. PCT/CA2008/000469 filed Mar. 3, 2008, which claims priority to U.S. Provisional No. 60/892,289 filed Mar. 1, 2007.

FIELD OF THE INVENTION

The present invention relates to vehicular passive entry door latches and more particularly to vehicular passive entry door latches with a double lock feature.

BACKGROUND OF THE INVENTION

Some vehicular door latches include a double lock, which disables both the inside and outside door handles of the vehicle door, and also disables a door lock knob if one is provided. This makes the vehicle more difficult for an unauthorized person to enter, even if they break the door window.

Some vehicular door latches also include a passive entry feature, which permits the vehicle to be opened by an authorized person (ie. a person in possession of the key fob) without the authorized person having to press a button on the key fob. Instead, the person simply pulls the door handle to open the door. In order to quickly permit the door to be opened when it is in a locked and double locked state, a power release motor is used to directly release the pawl that locks the ratchet, bypassing the lock and double lock mechanisms. After the power release signal is sent to the power release motor, subsequent signals are also sent to unlock and undouble lock the vehicle door. It is possible for the power release signal to be sent successfully, permitting the door to be opened by the authorized person, while the undouble lock signal fails for some reason. In such a scenario, the person could open the door, enter the vehicle, and then be trapped inside the vehicle as the double lock would remain engaged.

It would be advantageous to provide a means for preventing the possibility of the double lock mechanism of remaining locked when an authorized person opens the vehicle door.

SUMMARY OF THE INVENTION

In a first aspect, the invention is directed to a door latch for a vehicle door. The door latch includes a ratchet that is used to hold a striker. The door latch further includes a double lock. Movement of the ratchet to an open position causes the double lock to be un-double locked. Preferably, the ratchet is operatively connected to the double lock by a mechanical linkage.

In a particular embodiment of the first aspect, the door latch system includes a ratchet, a pawl, a release lever, a lock link, a double lock lever and a double lock override lever. The ratchet is movable between a closed position for holding a striker, and an open position. The ratchet may be biased to the open position. The pawl is movable between a ratchet locking position wherein the pawl holds the ratchet in the closed position, and a ratchet release position wherein the pawl permits the ratchet to move to the open position. The pawl may be biased towards the ratchet release position. The release lever is movable between a rest position and a pawl release position. The lock link is movable between an engagement position and a disengagement position. In the engagement position the lock link is positioned to transfer movement of the release lever to the pawl release position into movement of the pawl to the ratchet release position. In the disengagement position the lock link does not transfer movement of the release lever to the pawl release position into movement of the pawl to the ratchet release position. The double lock lever is movable between a double locking position wherein the double lock lever prevents movement of the lock link out of the disengagement position, and an un-double locking position wherein the double lock lever permits movement of the lock link to the engagement position. The double lock override lever is movable between a first position wherein the double lock override lever prevents the double lock lever from being in the double locking position, and a second position wherein the double lock lever is movable to the double locking position. The ratchet has a double lock override control surface thereon that is positioned to move the double lock override lever to the first position when the ratchet moves to the open position.

BRIEF DESCRIPTION OF THE DRAWINGS

The present invention will now be described by way of example only with reference to the attached drawings, in which.

DETAILED DESCRIPTION OF THE INVENTION

Figure 1A:
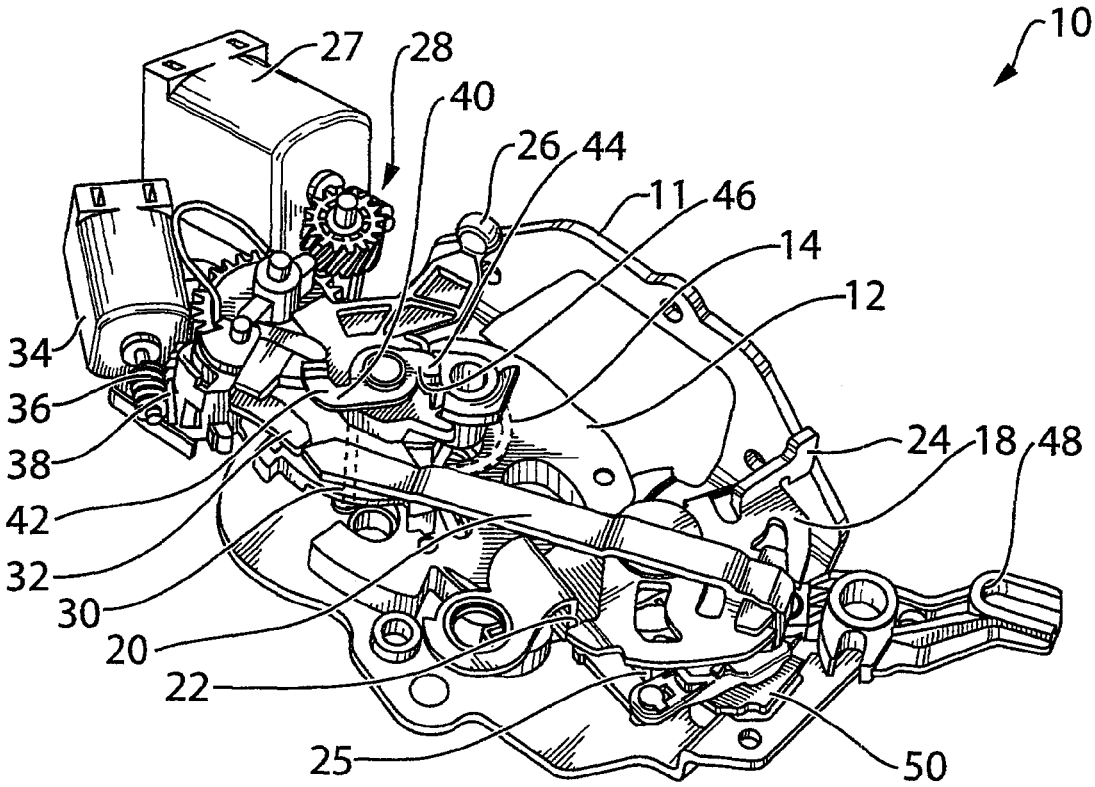
FIG. 1*a* is a perspective view of a door latch in accordance with an embodiment of the present invention, in a double locked position.
Figure 1B:
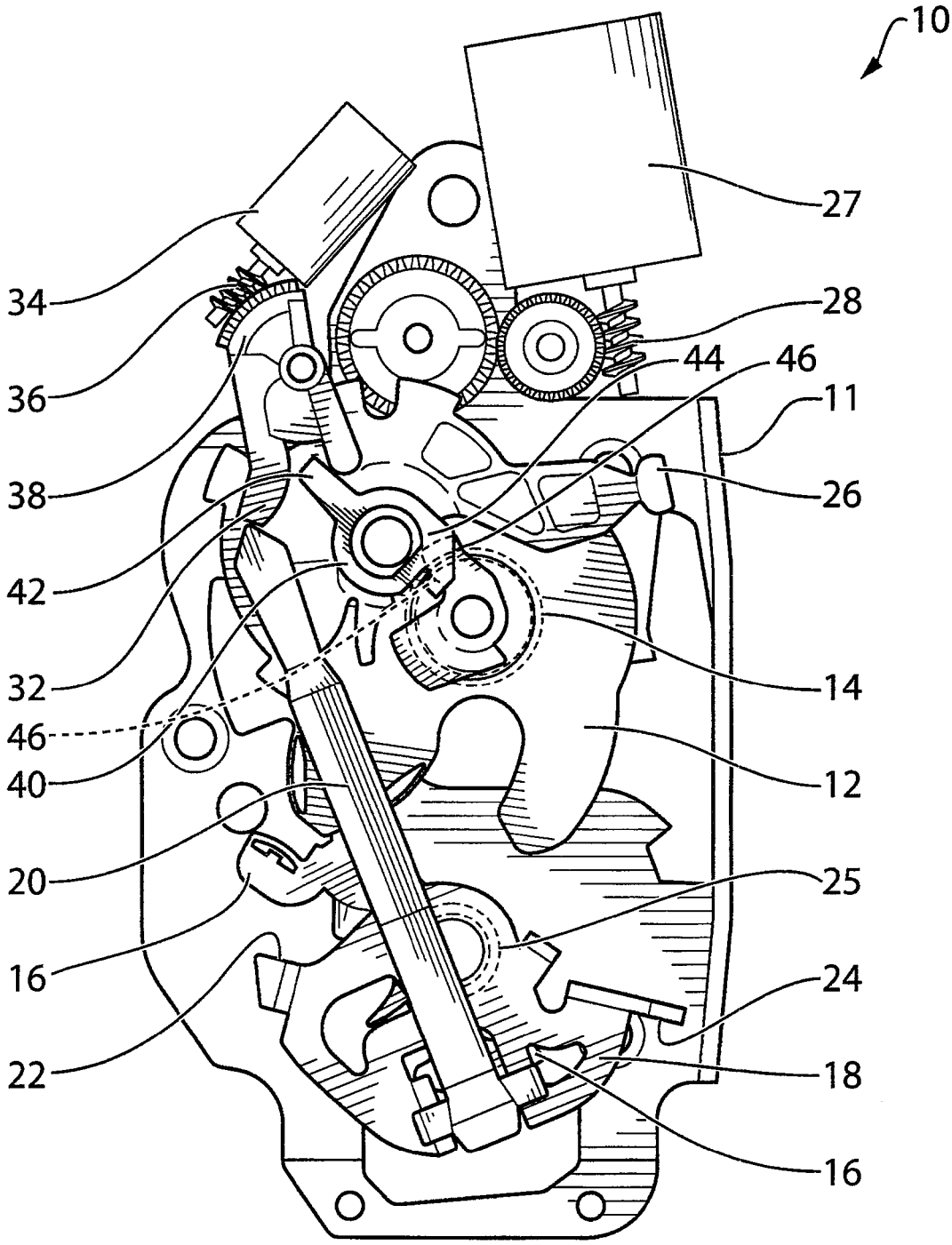
FIG. 1*b* is a plan view of the door latch shown in FIG. 1*a*, in the double locked position.

Reference is made to FIGS. 1*a* and 1*b*, which show a door latch 10 in accordance with an embodiment of the present invention, in a double locked position. The door latch 10 includes a housing 11 that is shown in part in the figures, includes a ratchet 12 that is movable between a closed position shown in FIGS. 1*a* and 1*b* wherein it holds a striker (not shown) and an open position shown in FIGS. 2*a* and 2*b* to release the striker. The ratchet 12 is biased towards the open position by a biasing member 14 (FIG. 3*b*), which may be any suitable type of biasing member, such as a torsion spring.

The door latch 10 further includes a pawl 16 (shown more clearly in FIGS. 3*a* and 3*b*) that is movable between a ratchet locking position (FIG. 3*b*) wherein it holds the ratchet 12 in the closed position and a ratchet release position (FIG. 3*a*) wherein it permits the ratchet 12 to move to the open position under the urging of its biasing member 14.

The pawl 16 is biased towards the ratchet locking position by a biasing member 17, which may be any suitable type of biasing member, such as a torsion spring.

Referring to FIGS. 1*a* and 1*b*, the pawl 16 is movable to its ratchet release position by a release lever 18, through a lock link 20. The release lever 18 has an outside door handle actuation surface 22 to which the outside door handle (not shown) is operatively connected for opening the ratchet 12, and an inside door handle actuation surface 24 to which the outside door handle (not shown) is operatively connected for opening the ratchet 12. The release lever 18 is movable between a rest position (shown in the figures) and a pawl release position which is described further below. The release lever 18 may be biased towards the rest position by a suitable biasing member 25 which may be a torsion spring.

The lock link 20 is movable between an engagement position (FIG. 2*b*) and a disengagement position (FIG. 1*b*). In the engagement position (FIG. 2*b*), the lock link 20 is engageable with the pawl 16 and transfers movement of the release lever 18 to the pawl 16, so that when the release lever 18 moves to the pawl release position, the pawl 16 is moved to the ratchet release position. When the lock link 20 is in the disengagement position (FIG. 1*b*), the lock link 20 is not engageable with the pawl 16 and therefore does not transfer movement of the release lever 18 to the pawl 16, so that when the release lever 18 is moved to the pawl release position, the pawl 16 remains in the ratchet locking position. The lock link 20 may be held in the engagement and disengagement positions by friction and therefore may optionally not be biased towards either of the positions.

A lock lever 26 is operatively connected to the lock link 20 to move the lock link 20 between the engagement and disengagement positions. The lock lever 26 is positionable in a locking position (FIG. 1*b*) wherein it positions the lock link 20 in its disengagement position, and an unlocking position (FIG. 2*b*) wherein it positions the lock link 20 in the engagement position. The lock lever 26 may be moved to its locking and unlocking positions by any suitable means, such as by a lock actuation motor 27 through a lock actuation linkage 28. The lock lever 26 may be biased towards both of its locking and unlocking positions by a suitable biasing member (not shown). The lock lever 26 may also be movable manually to its locking and unlocking positions by means of a manual lock actuation lever (not shown).

Figure 2A:
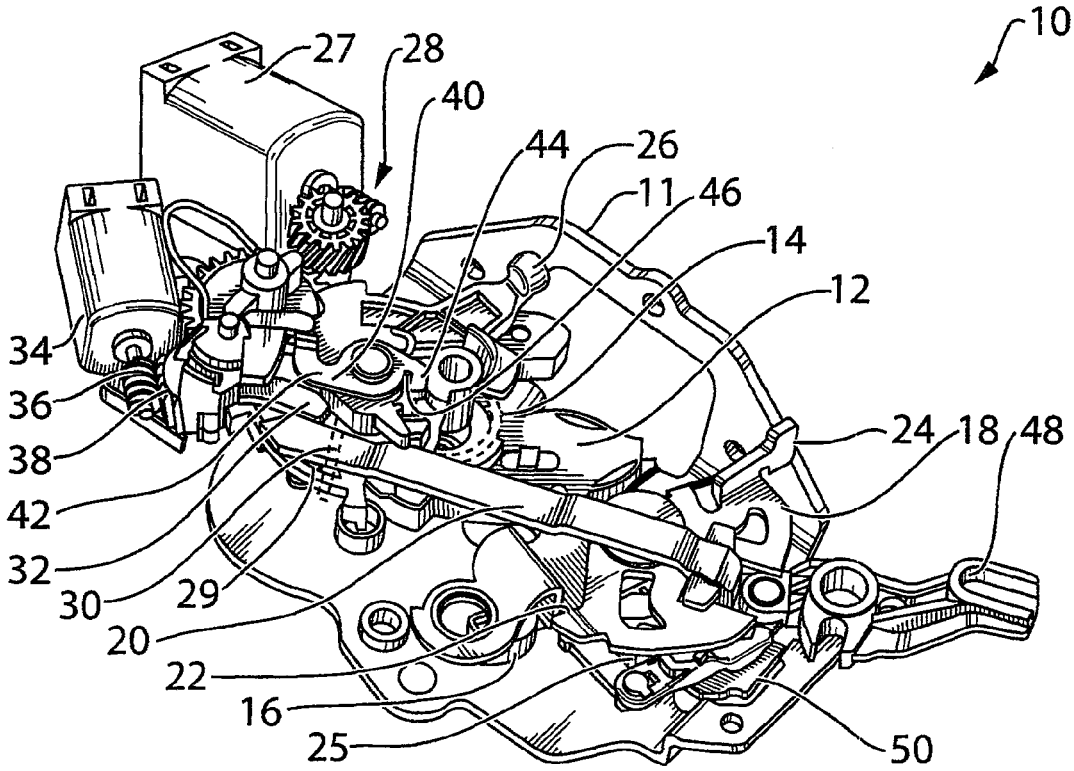
FIG. 2*a* is a perspective view of the door latch shown in FIG. 1*a*, in an un-double locked position.

The lock link 20 is positioned in a slot 29 (FIGS. 2*a* and 2*b*) in the lock lever 26 and is biased towards a rest position in the slot 29 (which may be at one end of the slot 29) by means of a biasing member 30 (FIGS. 1*a* and 2*a*). The biasing member 30 may be selected to be sufficiently stiff to resist flexure during movement of the lock link 20 between the engagement and disengagement positions by the lock lever 26. However, the presence of the biasing element 30 and the slot 28 permits relative movement between the lock link 20 and the lock lever 26.

A double lock lever 32 is positionable in a double locking position (FIG. 1*a* and 1*b*) wherein it blocks the movement of the lock link 20 out of its disengagement position, and an un-double locking position (FIGS. 2*a* and 2*b*) wherein it permits the movement of the lock link 20 to its engagement position.

When the double lock lever 32 is in the double locking position (FIG. 1*b*), rotation of the lock lever 26 to its unlocking position does not cause the movement of the lock link 20 to its engagement position. Instead the lock link biasing member 30 flexes and the lock link 20 remains in the disengagement position. Thus, when the double lock lever 32 is in the double locking position, neither the lock actuation motor 27 nor the manual lock actuation lever (not shown) would be effective in unlocking the door latch 10 (ie. in moving the lock link 20 to the engagement position).

The double lock lever 32 may be moved to the double locking position by any suitable means. For example, a double lock actuation motor 34 may be provided, to which a worm gear 36 is connected. The worm gear 36 engages a sector gear 38 that is fixedly connected to the double lock lever 32. The double lock actuation motor 34 may be bi-directional so that it can be used to move the double lock lever 32 to both its double locking and un-double locking positions.

Figure 3A:
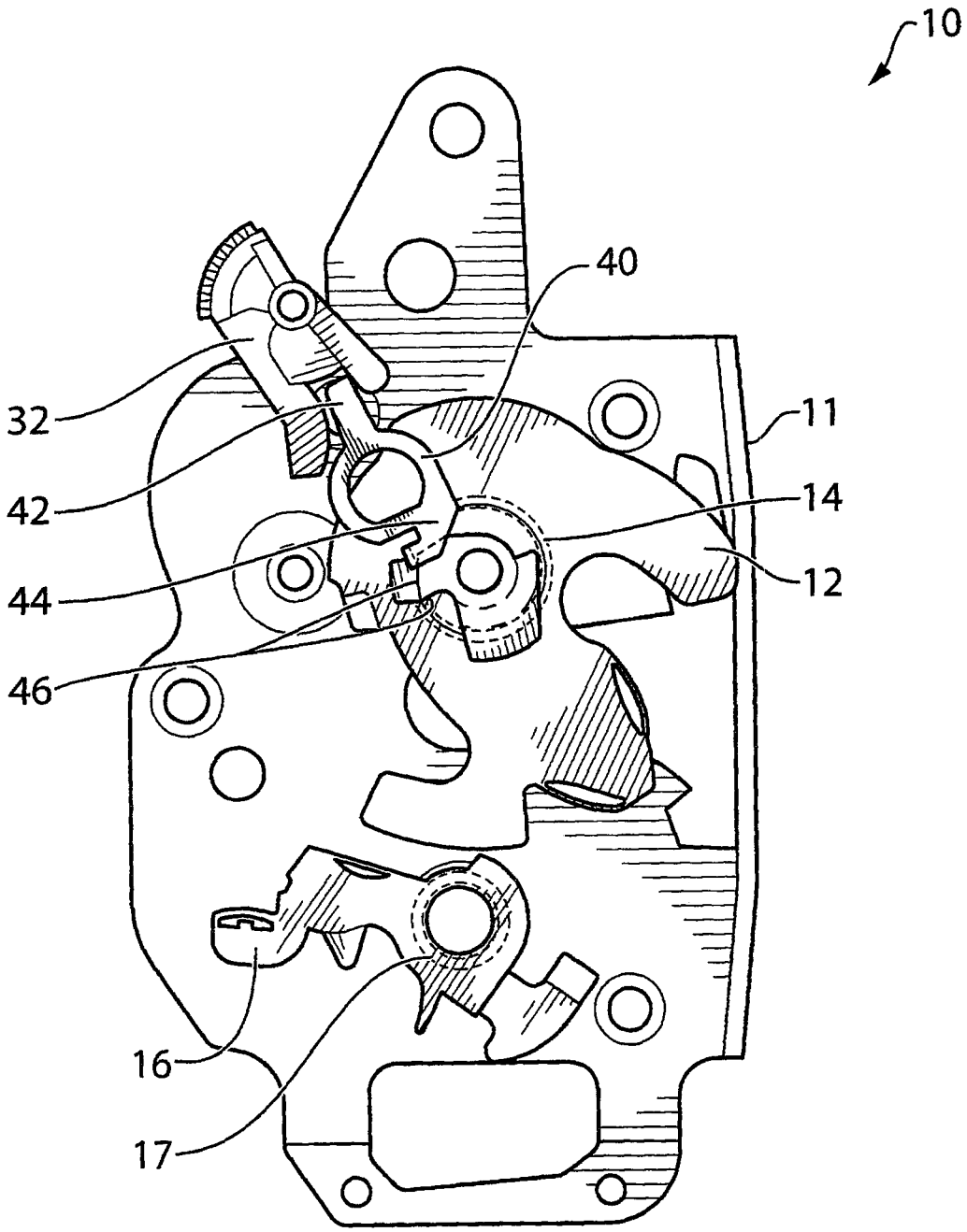
FIG. 3*a* is a magnified plan view of selected elements from the door latch shown in FIG. 1*a* in one position.
Figure 3B:
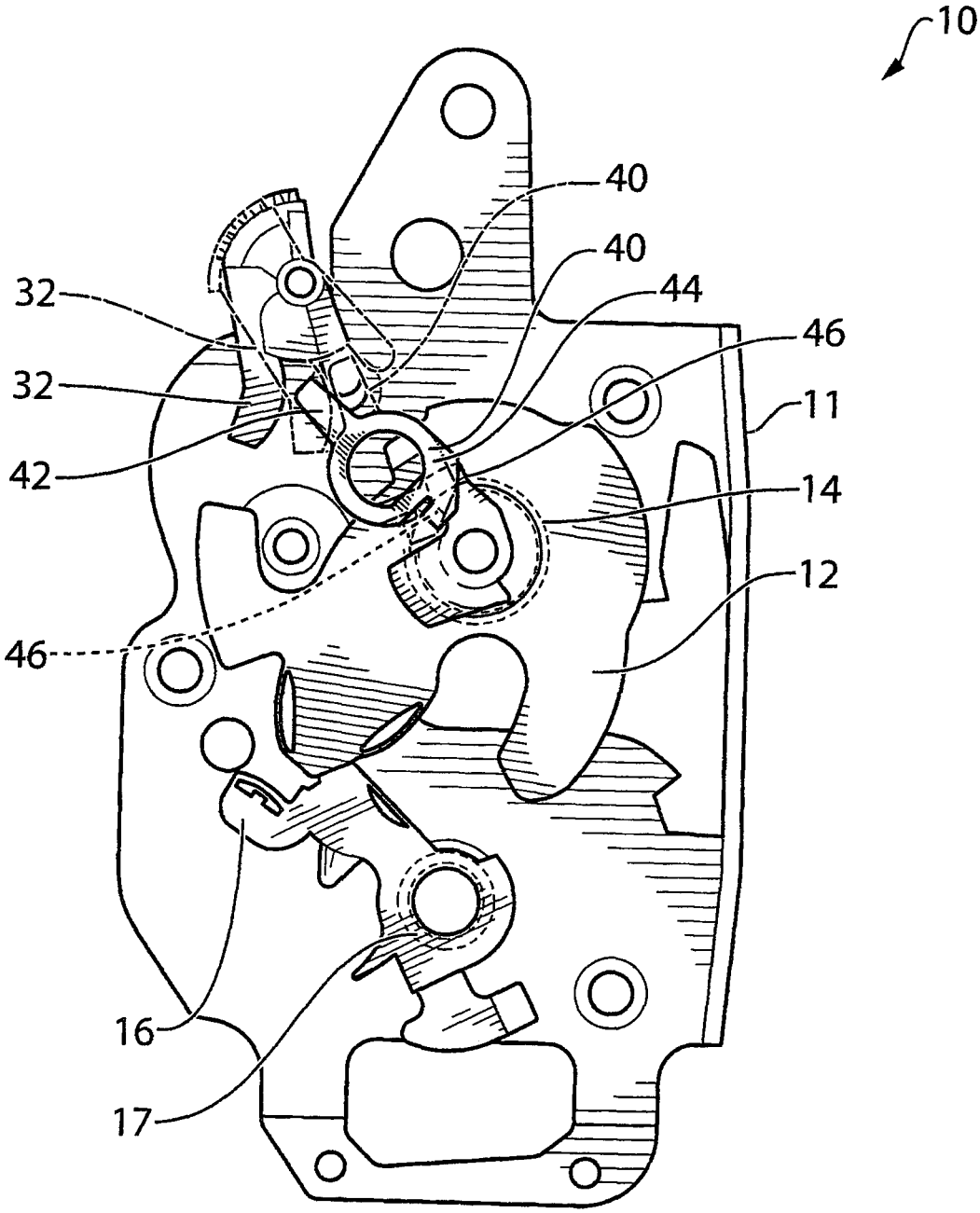
FIG. 3*b* is a magnified plan view of the selected elements shown in FIG. 3*a*, in another position.

A double lock override lever 40 is provided and has a first lever arm 42 which is engageable with the double lock lever 32, and a second lever arm 44 which is engageable with a double lock override control surface 46 (seen more clearly in FIGS. 3*a* and 3*b*) on the ratchet 12. The double lock override lever 40 is movable between a first position (FIG. 3*a*) and a second position (FIG. 3*b*). Referring to FIG. 3*a*, when the ratchet 12 is in the open position, the double lock override lever 40 is in the first position, and the double lock override control surface 46 prevents the double lock override lever 40 from moving out of the first position, which in turn prevents the double lock lever 32 from moving out of its un-double locked position. When the ratchet 12 moves to the closed position (FIG. 3*b*) the double lock lever 32 is movable to either the double locking position (shown in solid outline) or the un-double locking position (shown in dashed outline). In this situation the position of the double lock lever 32 to some extent controls the position of the double lock override lever 40. If the double lock lever 32 is in the double locking position (shown in solid outline), the double lock override lever 40 is in the second position (shown in solid outline). When the double lock lever 32 is in the un-double locking position, (shown in dashed outline), the double lock override lever 40 may be in a range of positions between the first and second positions.

If the double lock lever 32 is in the double locking position, movement of the ratchet 12 to the open position causes the double lock override control surface 46 to move the double lock override lever 40 to its first position, which in turn moves the double lock lever 32 to its un-double locking position.

Figure 2B:
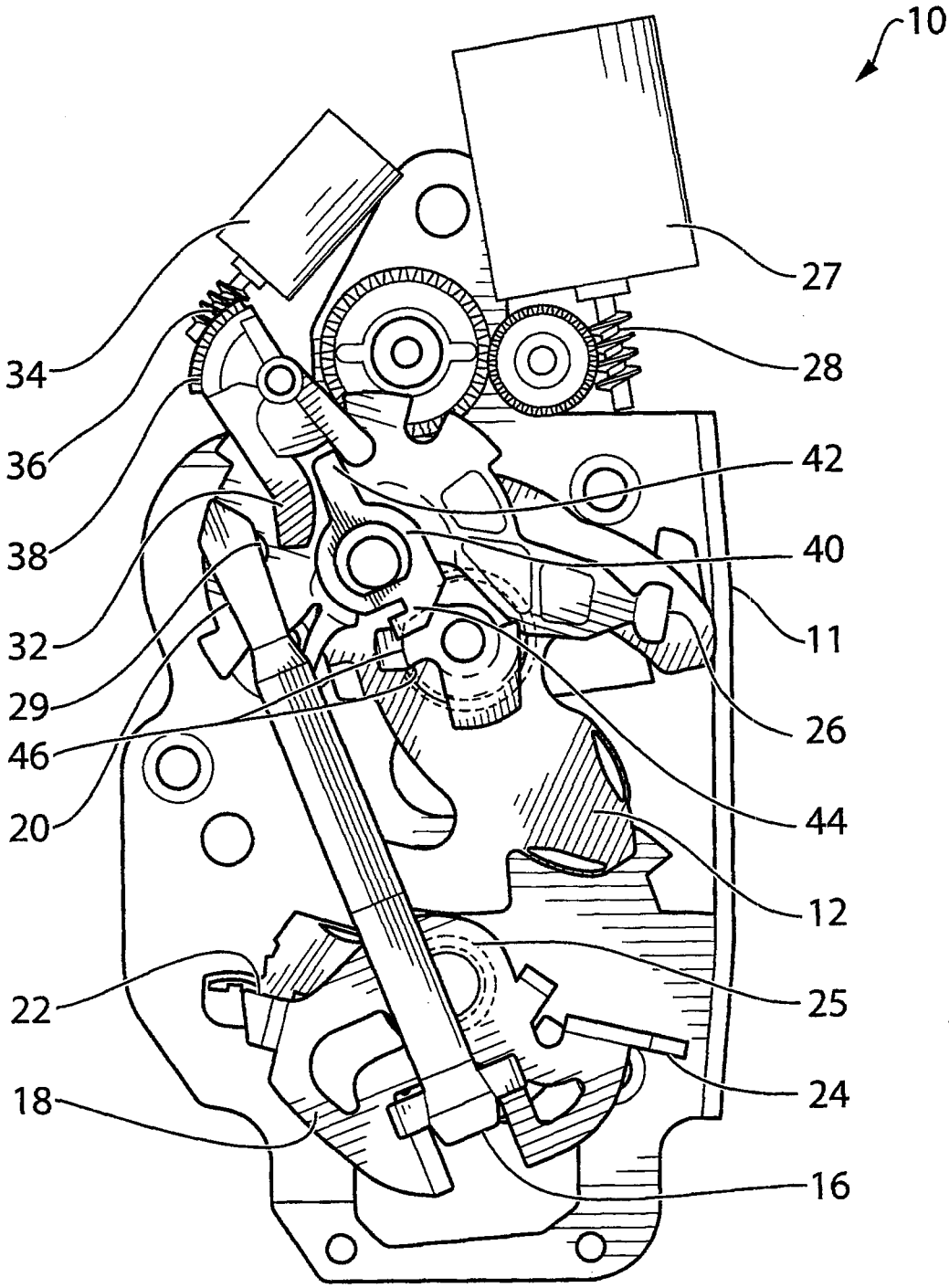
FIG. 2*b* is a plan view of the door latch shown in FIG. 1*a*, in the double locked position.

It will be noted from FIGS. 2*a* and 2*b* that the double lock lever 32 cannot be moved to its double locking position when the lock link 20 is in the unlocking position.

As can be seen in FIG. 3*a*, the double lock override control surface 46 is positioned on an arm that appears in plan view to be so long that it would interfere with the ability of the ratchet 12 to be rotated from its open position (FIG. 3*a*) to its closed position (FIG. 3*b*). However, the outer end of the arm is configured to pass under the second lever arm 44 of the double lock override lever 40 when the ratchet 12 moves to the closed position shown in FIG. 3*b*.

In operation, if an authorized person, ie. a person who has the appropriate key fob (not shown), lifts the outside door handle (not shown) while the door latch 10 is double locked (as shown in FIGS. 1*a* and 1*b*), a power release actuator (not shown) may operate a passive entry door latch opening lever 48 (FIG. 2*a*), which itself engages a passive entry pawl unlocking link 50 (FIG. 2*a*), which moves the pawl 16 to its unlocking position, which in turn permits the ratchet 12 to move to its open position. As the ratchet 12 rotates to its open position, the double lock override control surface 46 rotates the double lock override lever 40 from the first position shown in FIGS. 1*a* and 1*b* to the second position shown in FIGS. 2*a* and 2*b*. During this movement of the double lock override lever 40, the sector gear 38 drives the worm gear 36 to rotate even though the double lock actuation motor 34 is not powered. As a result, the double lock override lever 40 moves the double lock lever 32 from the double locking position shown in FIGS. 1*a* and 1*b* to the un-double locking position shown in FIGS. 2*a* and 2*b*. By linking the un-double locking operation mechanically to the opening of the ratchet 12, a situation is avoided wherein the double lock remains locked when the ratchet 12 is opened. By preventing the double lock lever 32 from being moved to its double locking position when the ratchet 12 is in the open position, a situation is avoided whereby the person inadvertently locks the double lock lever 32 while the person is entering the vehicle, ie. while the vehicle door (not shown) is open.

While the above description constitutes a plurality of embodiments of the present invention, it will be appreciated that the present invention is susceptible to further modification and change without departing from the fair meaning of the accompanying claims.

The invention claimed is:

1. A door latch for a vehicle door, comprising:

a ratchet movable between a closed position for holding a striker, and an open position;

a pawl movable between a ratchet locking position wherein the pawl holds the ratchet in the closed position, and a ratchet release position wherein the pawl permits the ratchet to move to the open position;

a release lever movable between a rest position and a pawl release position;

a lock link movable between an engagement position and a disengagement position, wherein in the engagement position the lock link is positioned to transfer movement of the release lever to the pawl release position into movement of the pawl to the ratchet release position, and wherein in the disengagement position the lock link does not transfer movement of the release lever to the pawl release position into movement of the pawl to the ratchet release position;

a double lock lever movable between a double locking position wherein the double lock lever prevents movement of the lock link out of the disengagement position, and an un-double locking position wherein the double lock lever permits movement of the lock link to the engagement position; and a double lock override lever movable between a first position wherein the double lock override lever prevents the double lock lever from being in the double locking position, and a second position wherein the double lock lever is movable to the double locking position, wherein the ratchet has a double lock override control surface that rotates in a fixed relationship with the ratchet that is positioned to move the double lock override lever to the first position when the ratchet moves to the open position.

2. A door latch as claimed in claim 1, wherein the ratchet is biased to the open position and the pawl is biased towards the ratchet locking position.

3. A door latch as claimed in claim 1, wherein in the first position the double lock override lever prevents the double lock lever from moving to the double locking position.

4. A door latch as claimed in claim 3, wherein, when the ratchet is in the open position, the double lock override lever is held in the first position.

5. A door latch as claimed in claim 4, wherein, when the ratchet is in the closed position, the double lock lever is movable to both the double locking position and the un-double locking position.

6. A door latch as claimed in claim 1, further comprising a double lock actuation motor operatively connected to the double lock lever for moving the double lock lever to the double locking position.

* * * * *